US011365927B1

(12) United States Patent
Winters Giesting et al.

(10) Patent No.: US 11,365,927 B1
(45) **Date of Patent: *Jun. 21, 2022**

(54) COOLER WITH HINGING LID

(71) Applicant: The Gem Group, Inc., Lawrence, MA (US)

(72) Inventors: Meredith Winters Giesting, Brookline, MA (US); Agnes Csilla Domotor, Melrose, MA (US); Richard C. Bellofatto, Jr., Peabody, MA (US)

(73) Assignee: The Gem Group, Inc., Lawrence, MA (US)

( * ) Notice: Subject to any disclaimer, the term of this patent is extended or adjusted under 35 U.S.C. 154(b) by 87 days.

This patent is subject to a terminal disclaimer.

(21) Appl. No.: 16/837,186

(22) Filed: Apr. 1, 2020

Related U.S. Application Data

(63) Continuation-in-part of application No. 16/532,338, filed on Aug. 5, 2019, now abandoned, which is a continuation of application No. 15/614,493, filed on Jun. 5, 2017, now Pat. No. 10,371,429.

(60) Provisional application No. 62/353,591, filed on Jun. 23, 2016.

(51) Int. Cl.
*F25D 3/08* (2006.01)
*B65D 43/16* (2006.01)

(52) U.S. Cl.
CPC ..... *F25D 3/08* (2013.01); *B65D 43/161* (2013.01); *B65D 2251/1083* (2013.01)

(58) Field of Classification Search
CPC . F25D 3/08; B65D 43/161; B65D 2251/1083; B65D 21/064; B65D 43/18; B65D 43/16; B65D 43/22
USPC .... 220/592.2, 819, 820, 821, 822, 282, 283, 220/826, 840; 383/62
See application file for complete search history.

(56) References Cited

U.S. PATENT DOCUMENTS

| | | | | |
|---|---|---|---|---|
| 1,080,551 | A | 12/1913 | Hartwell | |
| 4,143,695 | A | 3/1979 | Hoehn | |
| 4,812,054 | A | 3/1989 | Kirkendall | |
| 5,064,088 | A | 11/1991 | Steffes | |
| 5,505,307 | A | 4/1996 | Shink | |
| 6,206,567 | B1 | 3/2001 | Cyr | |
| 2007/0278234 | A1* | 12/2007 | Mogil ..... | A45C 11/20 220/592.2 |

* cited by examiner

*Primary Examiner* — Andrew D Perreault
(74) *Attorney, Agent, or Firm* — Loginov & Associates, PLLC; William A. Loginov

(57) ABSTRACT

A cooler with a hinging lid is comprised of a top deck having an opening and a unitary hinging lid to cover the opening; insulated sidewalls; and a bottom that together define an enclosed insulated inner volume for storage of objects. The inner volume can be accessed by opening the hinging lid. The hinging lid can be selectively opened, segment by segment, to access the inner volume while minimizing the exchange of air between the inner volume and the air surrounding the cooler. The hinging lid is comprised of a pull flap tab, an interior layer of reflective insulating material, at least one layer of support insulation material and a waterproof outer surface layer. The support insulation material of the hinging lid is divided into at least two discrete segments comprising a first segment and a second segment and can be articulated as a hinge between the segments.

14 Claims, 9 Drawing Sheets

COOLER WITH HINGING LID

RELATED APPLICATIONS

This application is a continuation-in-part of co-pending U.S. patent application Ser. No. 16/532,338, filed Aug. 5, 2019, entitled COOLER WITH HINGING LID, which is a continuation of U.S. patent application Ser. No. 15/614,493, filed Jun. 5, 2017, entitled COOLER WITH HINGING LID, which claims the benefit of U.S. Provisional Application No. 62/353,591, entitled COOLER WITH HINGING LID, filed Jun. 23, 2016, the teachings of each of which applications are incorporated herein by reference.

FIELD OF THE INVENTION

This invention is in the field of containers, and more particularly, to containers with a hinged openable lid.

BACKGROUND OF THE INVENTION

A portable cooler is an ice chest and typically comprises a single insulated chamber where ice, in the form of cubes, sealed or unsealed blocks, or the like, is placed in the chamber in proximity with items to be cooled. Coolers are often taken on picnics, and on vacation or holiday. Where summers are hot, they may also be used just for getting cold groceries home from the store, such as keeping ice cream from melting in a hot automobile. Even without adding ice, this can be helpful, particularly if the trip home will be lengthy. Cooling the internal volume of air within the chamber and sealing the chamber improves the function of the cooler. When a large amount of goods (for example, cans of beverages) are placed into the chamber, the volume of air is reduced. When the amount of ice is greater, a sustained cooling effect can be maintained for a greater period of time. More air to be cooled reduces the overall effectiveness of the portable cooler. It is a disadvantage of the cooler where the cooler is opened to replace or retrieve goods within the cooler, external air enters the chamber and must be further chilled by the ice in order to maintain the internal coolness of the cooler. It would be desirable to provide a cooler with a cover that can minimize the exchange of external air when the cooler is opened by minimizing the size of the opening.

SUMMARY OF THE INVENTION

A cooler with a hinging lid overcomes the disadvantages of the prior art by providing a hinging segmented lid that can be opened incrementally from a first segment to a last segment. A cooler with a hinging lid is comprised of a top deck having an opening and a hinging lid to cover the opening, the hinging lid attached to the cooler at a lid hinge, the hinging lid defining at least one articulating hinge extending through the hinging lid; insulated sidewalls; and a bottom. The top deck with the hinging lid, sidewalls and bottom define an enclosed insulated inner volume for storage of objects, wherein the enclosed insulated inner volume can be accessed by opening the hinging lid. The hinging lid comprises a top outer layer, a bottom inner layer, and a plurality of insulating members arranged along a length of the lid with a space between the insulating members, the space between the insulating members dividing the hinging lid into a first segment and a second segment, the insulating members located between the top outer layer and the bottom inner layer, wherein the articulating lid defines the articulating hinge located at the space between the insulating members. The hinging lid further comprises a layer of insulating material located between the top outer layer and the plurality of insulating members. The bottom inner layer is attached to the layer of insulating material, thereby further defining the at least one articulating hinge. The hinging lid further comprises an intervening septum layer between the insulating members and the layer of insulating material. The bottom inner layer is attached to the intervening septum layer at the space between the insulating members, thereby further defining the at least one articulating hinge. The cooler includes a first zipper between a first edge of the hinging lid and the opening, and a second zipper between a second edge of the hinging lid and the opening, whereby the lid can be selectively secured to the top deck by zipping the first and second zippers. At least a portion of the inner insulated volume is enveloped in a reflective insulating material. The cooler exterior is comprised of a waterproof woven synthetic material, thereby preventing liquids from leaking out of the bottom of the cooler. The hinging lid can be articulated for a first segment that is folded back to create an opening that provides access to the inner volume that is smaller than the opening in the top deck. The hinging lid can be articulated for the first segment and a second segment that are folded back to create an opening that provides access to the inner volume. The hinging lid comprises three discrete segments comprising the first segment, the second segment and a third segment. The hinging lid can be articulated for the third, second and first segments that are folded back to create an opening that provides access to the inner volume. The hinging lid can be selectively opened, segment by segment, to access the inner volume while minimizing the exchange of air between the inner volume and the air surrounding the cooler. An articulating lid for a cooler is comprised of a top outer layer, a bottom inner layer, and a plurality of insulating members arranged in a row along a length of the lid with a space between the insulating members, the insulating members located between the top outer layer and the bottom inner layer, wherein the articulating lid defines an articulating hinge located at the space between the insulating members. A layer of insulating material is located between the top outer layer and the plurality of insulating members. An intervening septum layer is located between the insulating members and the layer of insulating material. The bottom inner layer is attached to the intervening septum layer at the space between the insulating members, thereby further defining the articulating hinge. The articulating lid is further comprised of a portion of a first zipper located along the length of and at a first edge of the articulating lid, and the articulating lid further comprising a portion of a second zipper located along the length of and at a second edge of the articulating lid.

BRIEF DESCRIPTION OF THE DRAWINGS

The invention description below refers to the accompanying drawings, of which.

DETAILED DESCRIPTION

Figure 1:
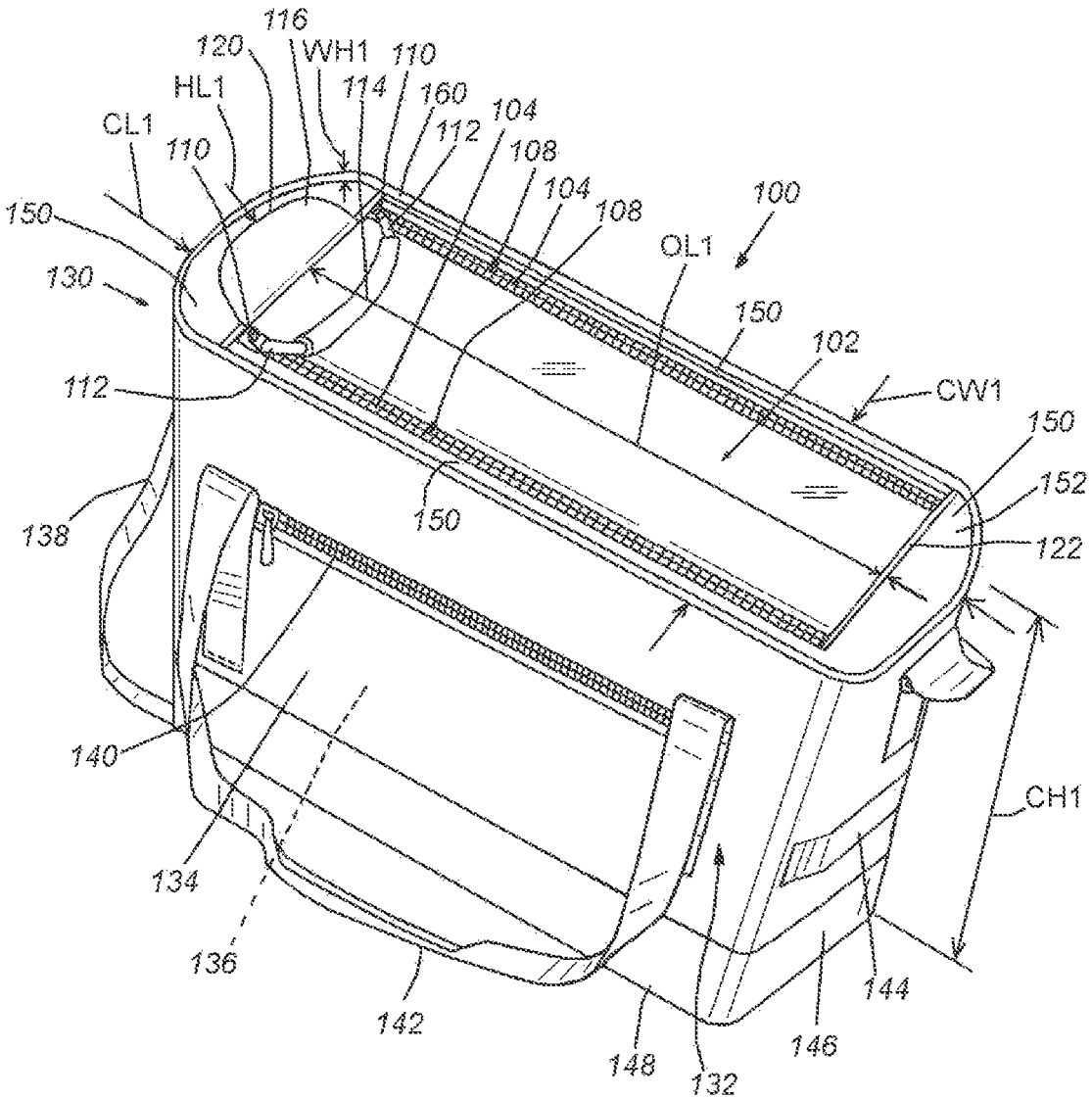
FIG. 1 is perspective view of a cooler with a hinging lid, according to a first embodiment.

FIG. 1 is perspective view of a cooler with a hinging lid, according to a first embodiment. A cooler 100 with a hinging lid 102 is an insulated container for keeping the contents placed into an interior volume at a lower temperature than the ambient temperature of the environment surrounding the cooler. A cooler can be an ice chest, with a surrounding enclosure, of which a part is an openable door. A door can be placed on the top of the cooler, and the door can be a lid. FIG. 1 depicts one embodiment of a cooler 100 with a hinging lid 102. The hinging lid 102 can be an assembly of interior insulation panels, an outer layer and inner layers, as will be set forth more fully below. The hinging lid 102 can be provided with lateral zippers 104 that are disposed along the sides 108 of the hinging lid 102. The zipper closure mechanisms 110 can be united by a portion of strap 112 that can be enclosed within a segment of hollow tubular metal 114 that serves as a single zipper pull and exerts even pressure on each zipper closure mechanism 110 to provide for an even opening of both zippers 104. A pull flap tab 116 can be attached at one end of the hinging lid 102. The pull flap tab is placed at the openable end of the lid and provides a gripping point for an operator's hand when the lid is opened or closed.

In an embodiment, a cooler 100 with a hinging lid 102 can have an overall length CL1 of approximately 19.5 inches (49.5 cm) (+1 inch). The cooler 100 with a hinging lid 102 can have a height CH1 of approximately 12.5 inches (31.75 cm) (+1 inch). The length HL1 of the hinging lid 102 can be approximately 15 inches (38 cm) (+1 inch) measured from the forward end 120 of the pull flap tab 116 to the lid hinge 122. The cooler 100 can have an overall width CW1 of approximately 5 inches (12.7 cm) (+1 inch) measured from front to back. A portion of the hinging lid 102 covers an opening to the interior of the cooler 100 and the length OL1 of that portion can be 14 inches (31.5 cm). In other embodiments, it is expressly contemplated that the cooler 100 can be proportioned larger or smaller (as will be seen below) without compromising the functionality of the hinging lid. The cooler body assembly 130 can be an assembly of component parts that taken together create a structure with an interior volume for receiving and dispensing the contents through an opening (described more fully below) that is covered by the hinging lid 102. The cooler body assembly includes a surrounding vertical wall 132 that can be constructed with an outer surface layer 134 that is a first layer, an inner layer 136 of a semi-rigid insulation material that is a second layer, and an interior layer (not shown) that lines the interior volume of the cooler that is a third layer along the walls and floor. The outer first layer 134 and inner third layers can be constructed of a flexible material. For example, the outer first layer 134 can be constructed of a waterproof woven synthetic polymer, for example, a nylon weave. The interior third layer can be constructed of a waterproof material that can be reflective, and otherwise assist in trapping heat/cold and moisture. The interior third layer can also be a material that has anti-microbial properties for better cleanliness, for example, heat sealed PEVA (polyethylene vinyl acetate). The inner second layer 136 can be constructed of a semi-rigid insulating material, for example, a panel of foam. Moreover, the second layer can be a single elongated panel that is disposed such that it surrounds the interior volume of the cooler and its end meet. The outer first layer 134 can have attachments for a shoulder strap 138, a zippered side pocket 140, one or more handles 142 on opposing sides and optionally, additional handles 144. It is contemplated that additional zippered pockets or accessories (for example, a bottle opener) can be provided along the exterior surface of the cooler.

A bottom outer first surface layer 146 can be attached to the cooler bottom 148 and can be constructed of a flexible polymer, for example, a rubber or rubber-like material, such as neoprene or a coated neoprene. The cooler bottom 148 can be constructed with an inner second layer comprised of at least one layer of a semi-rigid or rigid insulating material. The cooler body 130 can include a top deck 150 that can be comprised of an outer first layer 152 that can be constructed of the same material as the sidewall. The top deck 150 can be optionally provided with a reinforcing second layer of a semi-rigid or rigid insulating material. The top deck 150 can have an interior third layer, and the interior third layer of the top deck 150 can be constructed of the same material as the interior of the sidewalls.

A raised welt 160 can extend around the perimeter of the top of the cooler and connect the sidewalls 132 to the top deck 150 by a stitching. This can be formed by stitching an additional strip of material that is folded over the exposed ends of the top deck and sidewalls. The welt 160 can have a height WH1 of approximately ⅜ inches (9.5 mm).

Figure 2:
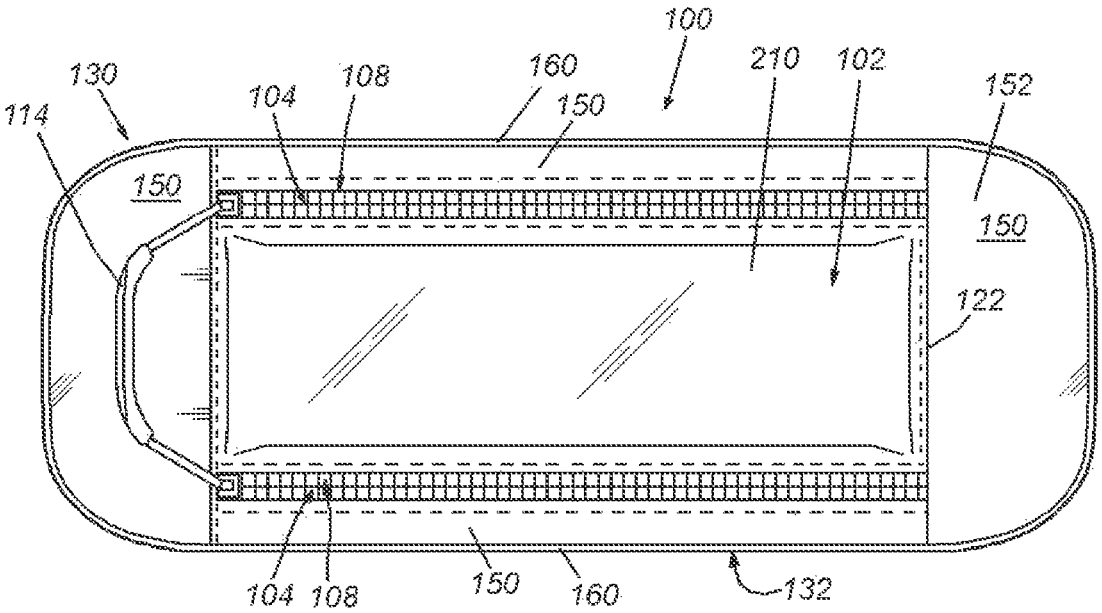
FIG. 2 is a top view of a cooler with a hinging lid, according to the first embodiment.

The top of the cooler 100 is depicted in FIG. 2. The top exterior layer 210 of the hinged lid 102 can be constructed of the same material and color as the surrounding wall 132. In other embodiments, the top exterior layer 210 can include a different material or color from the material of the surrounding wall 132.

Figure 3:
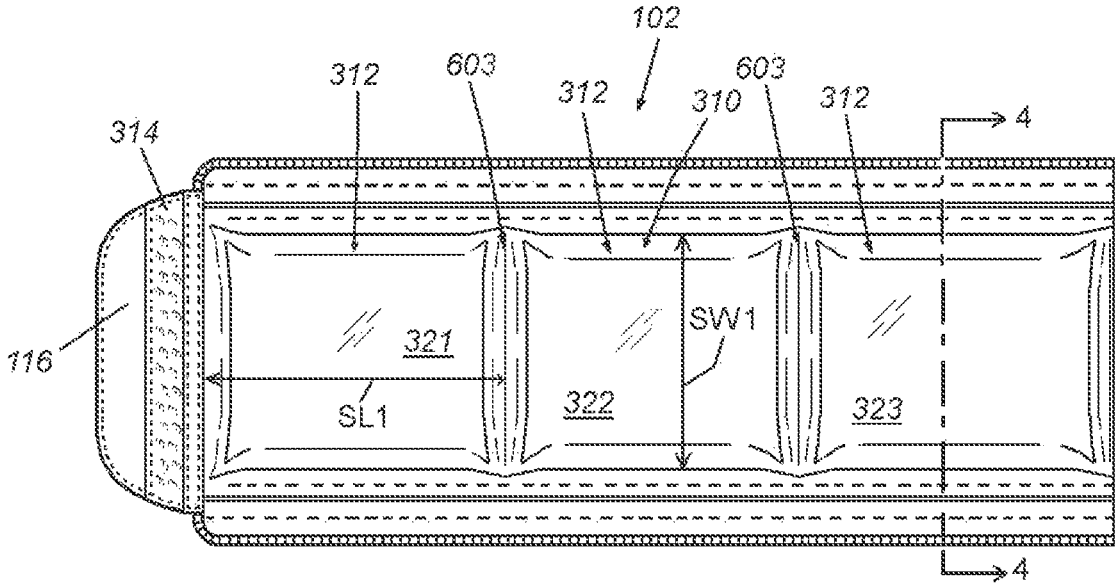
FIG. 3 is a bottom view of a hinging lid, according to the first embodiment.

The bottom side 310 of the hinging lid 102 is shown in FIG. 3. The interior volume of the cooler is created by the joinder of the surrounding vertical wall, the bottom, the top deck and the hinging lid. Thus, the bottom side 310 is also a removable top defining that interior volume. As noted above, the interior layer of the sidewalls can be constructed of a waterproof material that can be reflective, and otherwise assist in trapping heat/cold and moisture. The bottom side can be covered with a material that is similar to the interior layer of the sidewalls. In an illustrative embodiment, the hinging lid 102 is constructed with a rigid (or semi-rigid) support layer that is divided into at least two segments 312. The hinging lid 102 as shown is provided with three connected segments 312, that include a first segment 321, a second segment 322, and a third segment 323. In other embodiments, there can be two, four or more segments 312. In the illustrative embodiment, each of the segments 312 is uniform in size and shape from one to another. In other embodiments, each of the segments can be of various sizes. Each of the illustrative segments 312 can have a segment length SL1 of approximately 4.5 inches (11.5 cm) and a segment width SW1 of approximately 3.5 inches (9 cm). The end flap tab 116 can be provided with a segment of a hook and loop closure device 314 (as shown, the loop portion is on the bottom of the end flap tab, in other embodiments, the hook portion can be attached to the bottom of the end flap tab), and/or the end flap can be provided with at least one of a magnet, snaps, clips, or other device for holding the end flap 116 in place. A division of the support layer material into more than one segment provides for improved flexibility in the hinging lid 102 and a greater degree of movements, so that the hinging lid can be partially opened while a remainder of the lid remains anchored by the zippers. In alternate embodiments, the zippers can continue around from the sides to the end of the hinging lid, so that the lid can be secured to the top deck on three sides by zippers. In alternate embodiments, instead of having zippers, the hinging lid can be provided with side flaps having hook or loop surface, so that the hinging lid can be secured to the top deck of the cooler by hook and loop closures. The side flaps can be segmented, and can have breaks in the flaps between segments.

Figure 4:
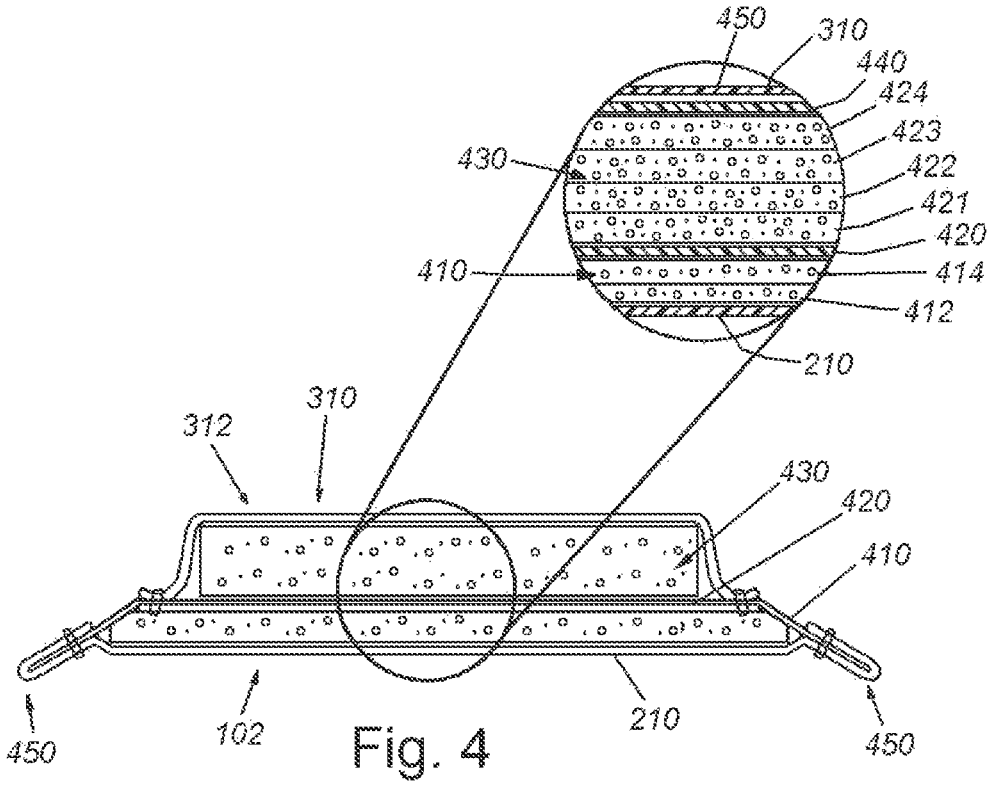
FIG. 4 is a cross section view taken along lines 4-4 of FIG. 3, according to the first embodiment.

FIG. 4 shows a cross section of the hinged lid taken along line 4-4 of FIG. 3, showing the inner structure of the hinging lid 102 with respect to the layers. In an illustrative embodiment, the top exterior layer 210 is shown as being "down", and the bottom side 310 is "up". The inner structure of the hinging lid 102 can be comprised of two layers of insulation, such as an open cell foam 410, 430 with an intervening septum 420. Working from the bottom to the top of the layers as shown in FIG. 4, a first layer 210 is the top exterior layer, now on the downside. A second layer is a layer of open cell foam 410 that resides on top of the first layer 210. It is contemplated that the second layer 410 can be a composite that can include more than one layer of open cell foam. In an embodiment, the second layer 410 can be composed of two sub-layers 412, 414 of 3 mm open cell foam panels, for an overall thickness of 6 mm. A third layer can be a septum 420 formed of a nonwoven material and can reside upon the second layer 410. A fourth layer can be a layer of open cell foam 430 that can reside on top of the third layer septum 420. It is contemplated that the fourth layer 430 can be a composite that can include more than one layer of open cell foam. In an embodiment, the fourth layer 430 can be composed of four sub-layers 421, 422, 423, 424 of 3 mm open cell foam panels, for an overall thickness of 12 mm. A fifth layer 440 can be formed of a nonwoven material and can reside upon the fourth layer 430. A sixth layer 450 can be the bottom of the lid 310 and can be constructed of a heat sealed PEVA (polyethylene vinyl acetate). The sixth layer can reside upon the fifth layer 440. In an embodiment, the material of the sixth layer can be stitched to the third layer 420 and the third layer 420 can be stitched to the first layer 210. A portion of the zippers 450 can be stitched at either side of the hinging lid 102. In the illustrative embodiment, the fourth layer 430 is thicker than the second layer 410. In other embodiments, the fourth layer 430 and second layer 410 can be of the same thickness, or the second layer 410 can be thicker than the fourth layer 430. The fourth layer 430 is shown as narrower than the second layer 410, so as to create a "stepped" appearance in cross section. In other embodiments, the layers can be uniform in width.

Figure 5:
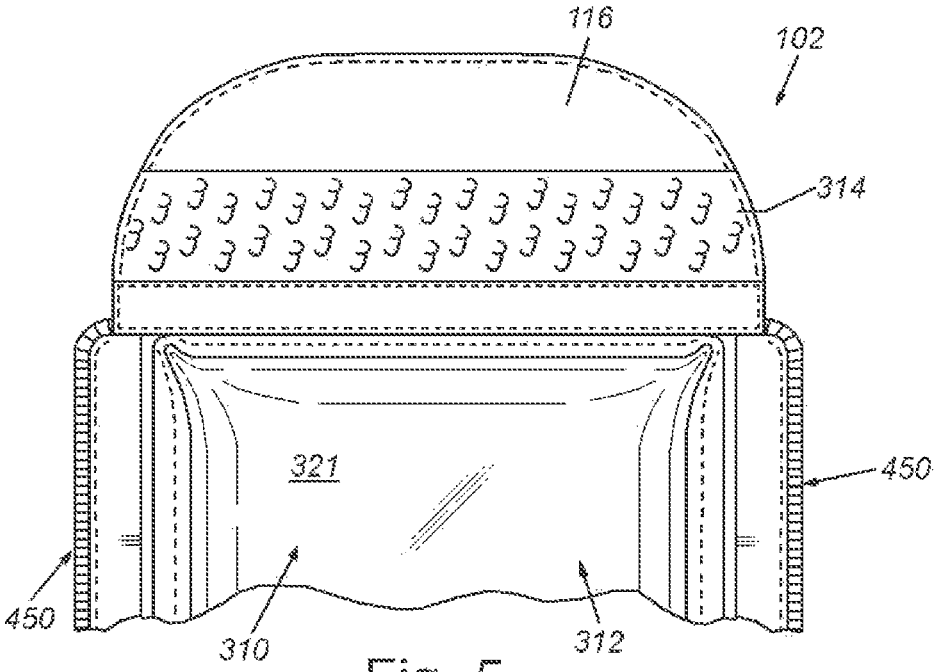
FIG. 5 is a close up view of the end portion of the inside of the hinged lid, according to the first embodiment.

The bottom side of an end of the hinging lid 102 is shown in detail in FIG. 5. This bottom side is an interior surface of the cooler when the lid is closed. The portion of the hook and loop closure 314, as noted above, is shown as a loop structure. This is a temporary closure mechanism that helps to maintain the relative coolness and moistness of the inner volume of the cooler. It is expressly contemplated that other closure mechanisms can be used, for example, magnets, snaps, clips or other closures.

Figure 6:
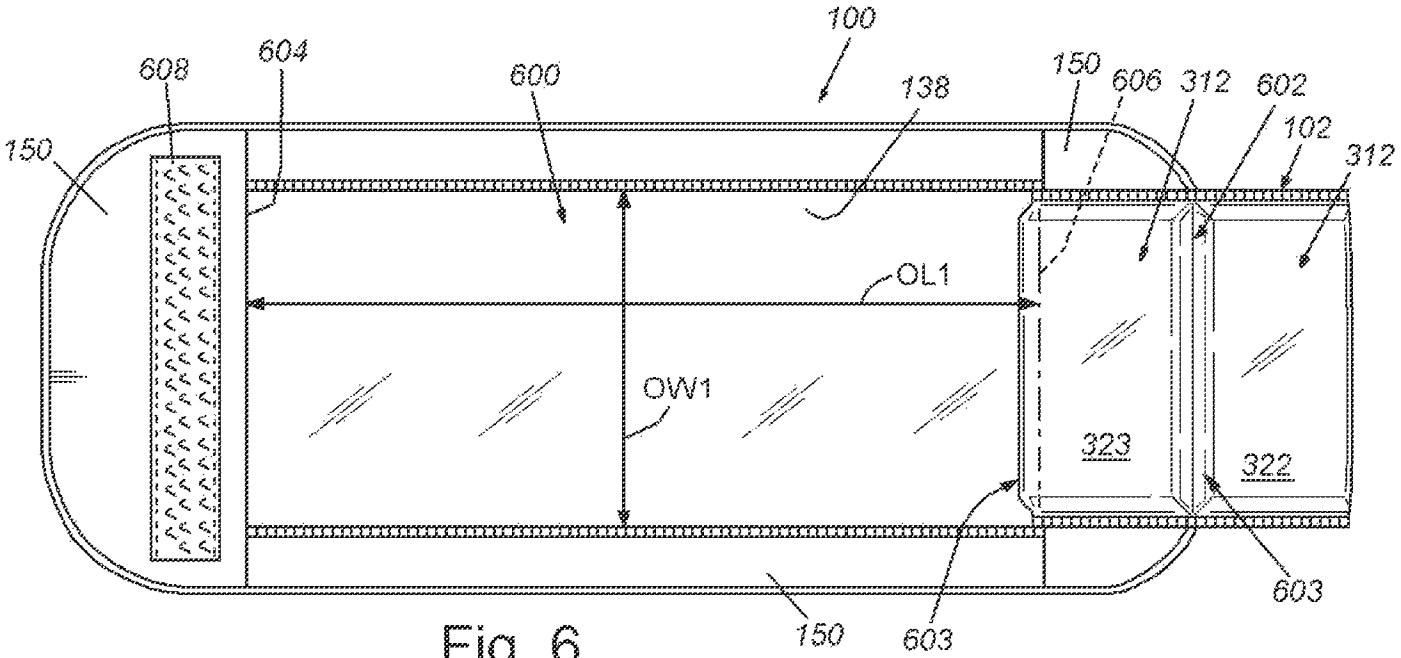
FIG. 6 is a top view of a cooler with a hinging lid, according to the first embodiment.

A fully opened cooler 100 is shown in FIG. 6, with the hinging lid 102 in a fully open state, uncovering the opening 600. In this state, the exchange of air between the interior volume of the cooler and the surrounding air is at a maximum. As noted above, the insulating support layers are divided into segments and this allows for articulation of the lid such that the illustrative lid appears to be "rolled back". This articulation will be more fully described below and is facilitated by seams 602 that can be free of internal support layers and are functionally flexible articulating hinges. Seams 602 can define articulating hinges 603 in the lid. The lid can have one or more articulating hinges 603 that extend from one side of the lid to the other side of the lid, so that the lid can have at least one hinge through the lid, in addition to the lid hinge at one end of the lid. The at least one articulating hinge 603 can allow a portion of the lid to be articulated into an open position, while another portion of the lid can remain in a closed position. In an embodiment, the opening 600 can be constructed with a width OW1 of 5 inches (12.5 cm) that is the same as the width of the hinging lid 102. The opening length OL1 is the distance from the front 604 of the opening to the rear 606 of the opening (shown in a broken line) that is the rear hinge of the hinging lid 102 and can be approximately 14 inches (35.5 cm) ±1 inch. A portion 608 of the hook and loop closure mechanism is for securing the hinging lid 102 to the top of the cooler 100. The illustrative portion 608 is depicted as a segment of hook material, stitched to the top deck 152, however it is specifically contemplated that the loop material can be on the top deck 150 and the hook material can be on the end flap 116, or that magnets, clips snaps, or other means can be used instead of hook and loop materials.

Figure 7:
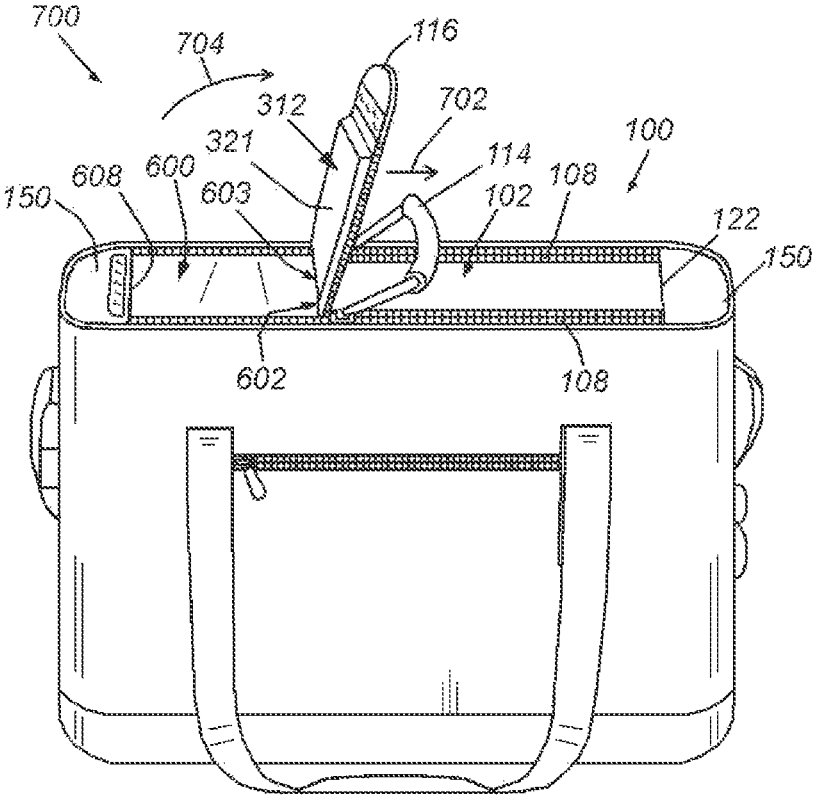
FIG. 7 is a side view of a cooler with a hinging lid in a first open position, according to the first embodiment.
Figure 8:
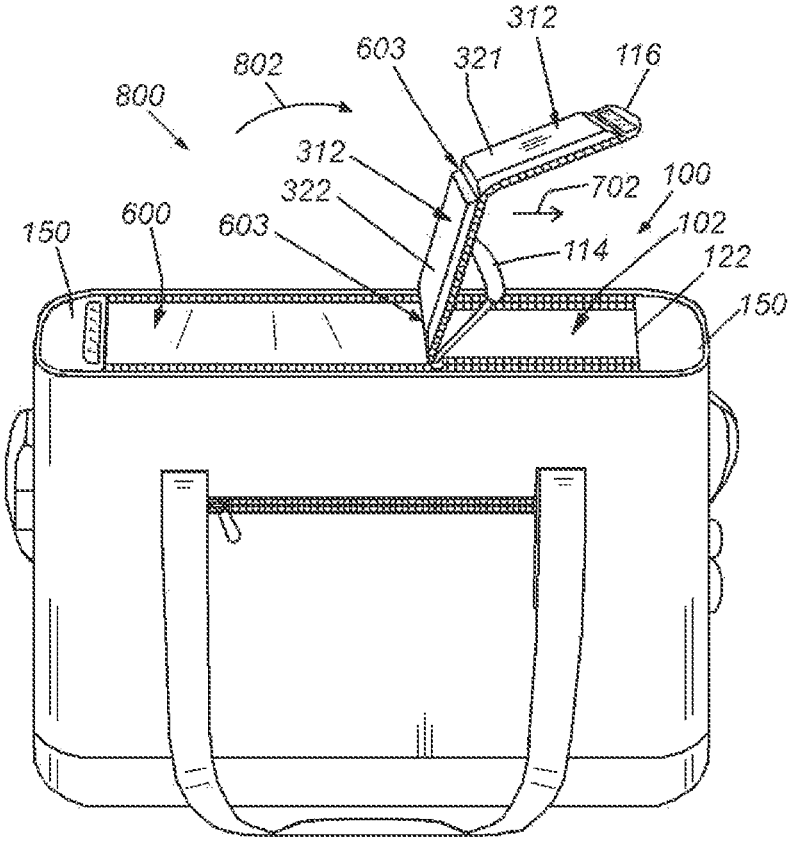
FIG. 8 is a side view of a cooler with a hinging lid in a second open position, according to the first embodiment.
Figure 9:
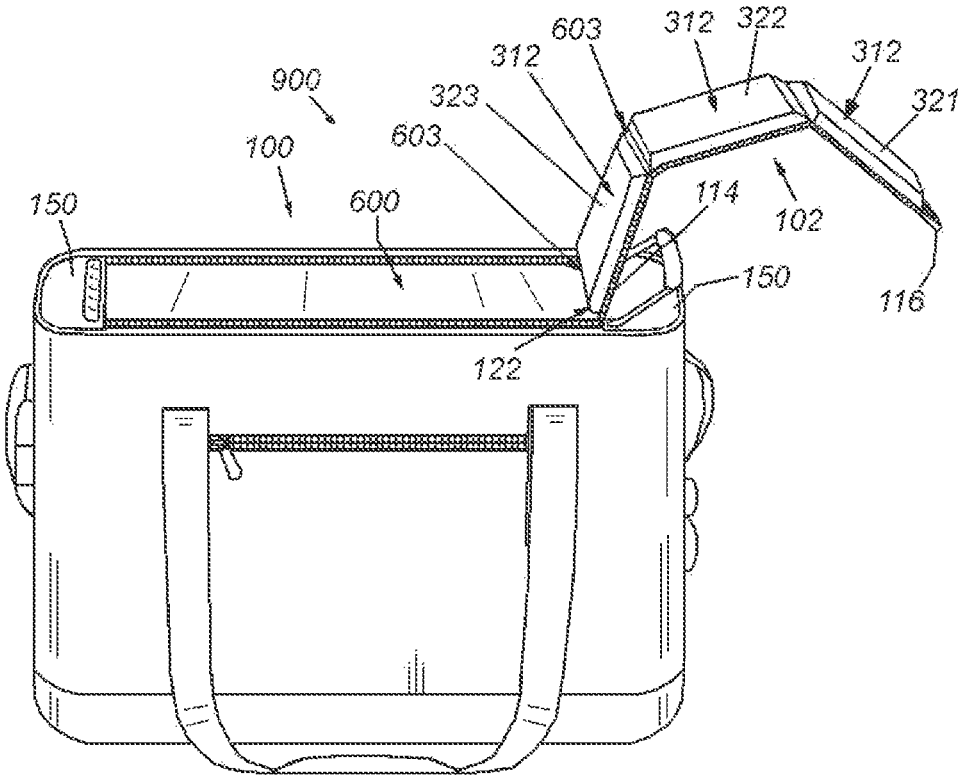
FIG. 9 is a side view of a cooler with a hinging lid in a third open position, according to the first embodiment.

The operation and articulation of the hinging lid 102 is shown in FIGS. 7 through 9. Prior to the opening of the hinging lid 102, the cooler is in a "closed" configuration, as shown in FIGS. 1 and 2, which can include the zippers 108 being closed by pulling the zipper handle 114 away from the rear of the opening towards the front of the opening. The pull flap tab 116 can be temporarily locked down on the top deck 152 by the mutual engagement of the hook and loop closure mechanism. A cooler with the hinging lid 102 in a first open position 700 is depicted in FIG. 7. This first open position 700 is defined as a position wherein the first segment 321 of the lid is opened and swung back in a direction away from the opening 600. The articulating hinge 603 can allow the first segment 321 to be hinged open at the articulating hinge 603, while the second segment 322 remains in a closed position. The first open position is desirable where a user wants to retrieve something (for example, a beverage container) from the interior volume of a cooler but does not want to remove the entire lid of the cooler, thereby causing the cooler air of the interior to escape, and after re-closure, expending coolant (for example, ice, cool packs, and the like) to re-cool the interior volume. The first open position 700 provides for access to the contents of the interior volume of the cooler with a minimal opening of the lid, thereby minimalizing the actual opening to an opening that can be one third of the total length of the opening because only one of the three segments 312 is articulated. This position retains a greater amount of cooled air within the interior volume, thereby extending the life of the coolant.

In operation, the user first manually unlocks the pull flap tab 116 from its engagement in the hook and loop closure mechanism by gripping the pull flap tab 116 and raising it until the hook and loop closure is disengaged. The user then opens the zippers by pulling the zipper handle 114 rearward, which is a directional vector proceeding away from the hook and loop closure and towards the hinge 122. The user continues to pull in a direction 702 until an entire segment 312 of the hinging lid 102 is free and the free portion of the lid can swing through a rearward arc 704 to allow access through a portion of the opening 600 to the contents in the interior volume of the cooler 100.

When the user desires to retrieve a larger item from among the contents of the interior of the cooler 100, for example, a melon or a gallon jug of liquid, the user can open the hinging lid 102 to a second open position 800, as shown in FIG. 8. This second open position 800 can be described as a position wherein the first segment 321 and the second segment 322 are opened and swung back away from the opening 600 and the third segment 323 can remain locked in place by the zippers. This position can double the length of the opening size of the first open position, but does not fully open the lid. Thus, while there is a greater exchange of the surrounding air with the cooler air of the interior volume of the cooler as compared to position 700, that exchange is still more limited than if the lid were entirely opened. To achieve the second open position 800, the user initiates the opening as set forth above, but continues to pull the zippers in a rearward direction 702 after the first open position until the second segment 322 has been freed and the freed portion of the lid can swing through a rearward arc 802. An articulating hinge 603 between the second segment 322 and the third segment 323 allows the first segment 321 and the second segment 322 to be swung into an open position at the articulating hinge 603, while the third segment 323 remains in a closed position.

A third open position 900 is defined as the state of the cooler 100 when the third segment 323 has been released and is articulated through a range of motion at the hinge 122, as shown in FIG. 9. In this configuration the hinged lid 102 has been entirely released from closure and the interior volume of the cooler is fully accessible from the outside. This is a useful configuration for packing, unloading and cleaning the cooler.

The steps for closing the hinged lid 102 are the same when the hinged lid is in any of the three open positions. First, the user grasps the zipper handle 114 and pulls the zippers 108 forward, engaging them in their respective closure mechanisms. When the zippers 108 are fully engaged, the pull flap tab 116 is pressed down so that the closure mechanism 314 engages and locks the pull flap tab 116.

Figure 10:
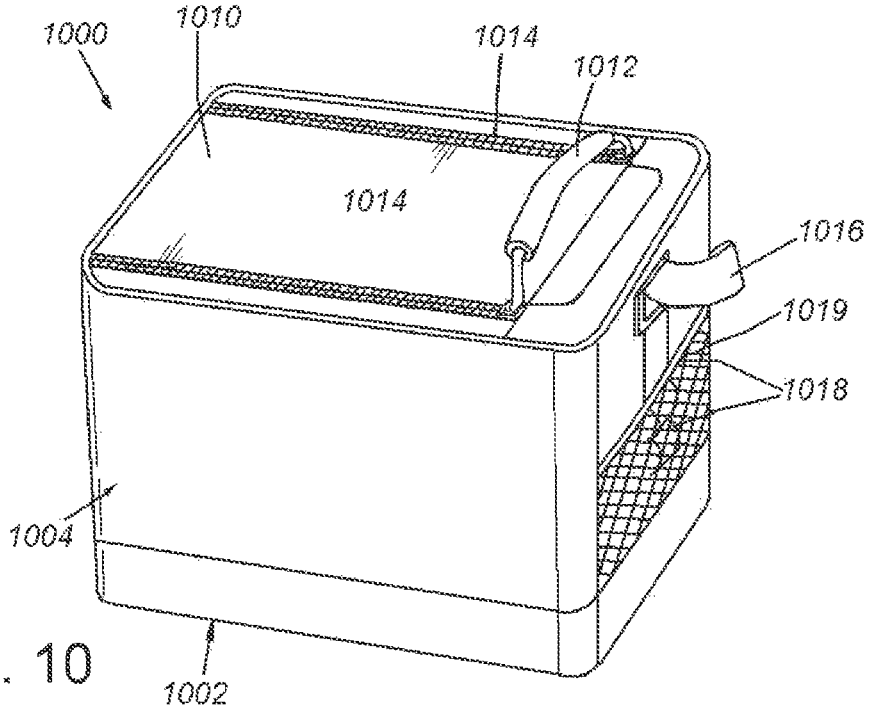
FIG. 10 is perspective view of a cooler with a hinging lid in a closed position, according to a second embodiment.

As noted above, the hinged lid cooler can be proportionally larger or smaller in dimensions than the illustrative first embodiment, and can have greater or smaller numbers of lid segments. FIGS. 10-14 depict a smaller cooler having a hinged lid that is divided into two segments. A smaller hinged lid cooler 1000 is shown in FIG. 10 with a bottom 1002, sidewalls 1004 and a hinged lid 1010. The structure of the sidewalls 1004 and bottom 1002 with support panels is the same as set out above, and creates an enclosed interior volume that can be kept cooler and moister than the surrounding air. The cooler 1000 includes a hinged lid 1010 that can be opened and closed by moving a handle 1012 that operates a pair of zippers 1014 in tandem. The cooler 1000 can be provided with a shoulder strap 1016. The cooler can also be provided with additional securement points 1018 and/or a mesh pocket 1019 for attaching and retaining things of importance, for example, keys, a bottle opener, sunglasses, electronics, or other items.

Figure 11:
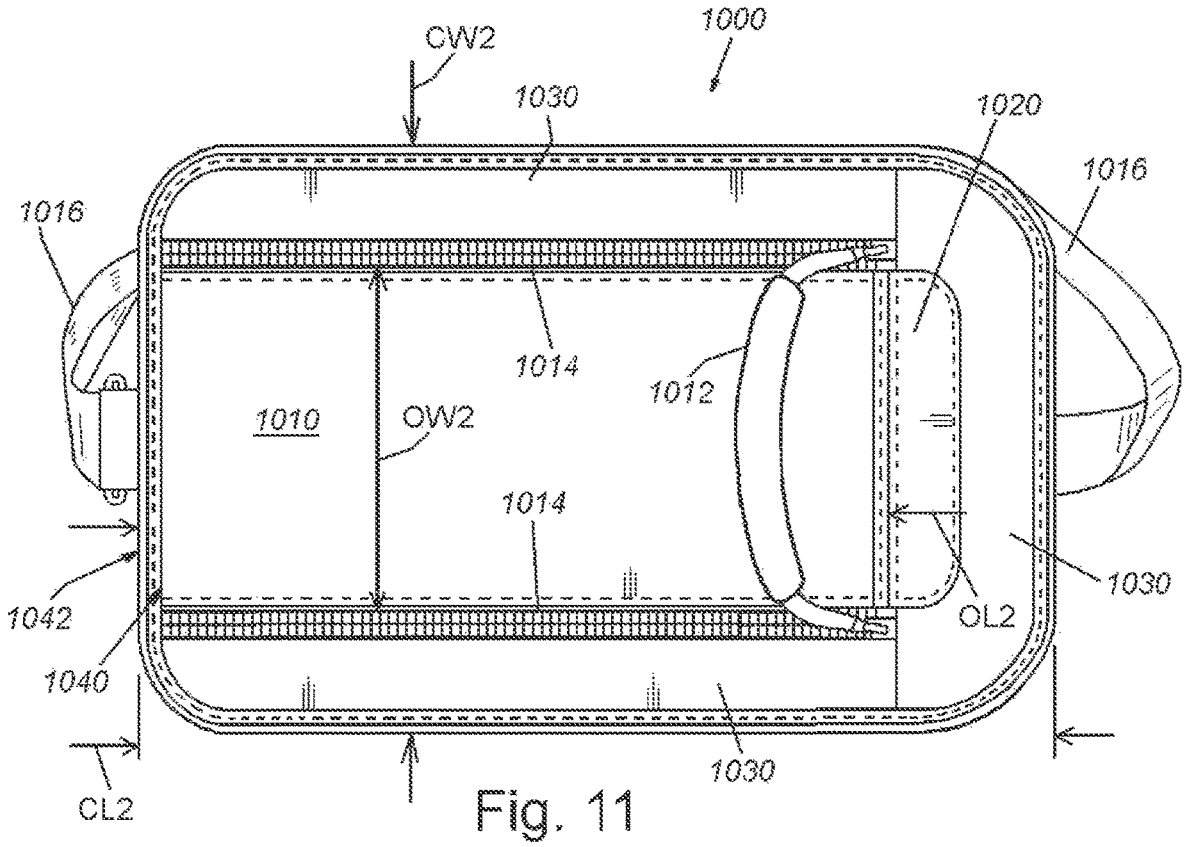
FIG. 11 is a top view of a cooler with a hinging lid, according to the second embodiment.

FIG. 11 is a top view of the cooler 1000. The hinged lid 1010 includes a pull flap tab 1020 that functions as the previously described pull flap tab 116. A top deck 1030 can surround the hinged lid 1010 on at least three sides. The hinge 1040 of the illustrative cooler 1000 can be located at the rear wall 1042. The illustrative cooler 1000 can have an overall width CW2 of approximately 7.5 inches (19 cm) (+1 inch) measured from front to back and a length CL2 of approximately 12 inches (30 cm). The hinged lid 1010 covers an opening that can have a width OW2 of 5.5 inches (14 cm) and a length OL2 of 9 inches (23 cm).

Figure 12:
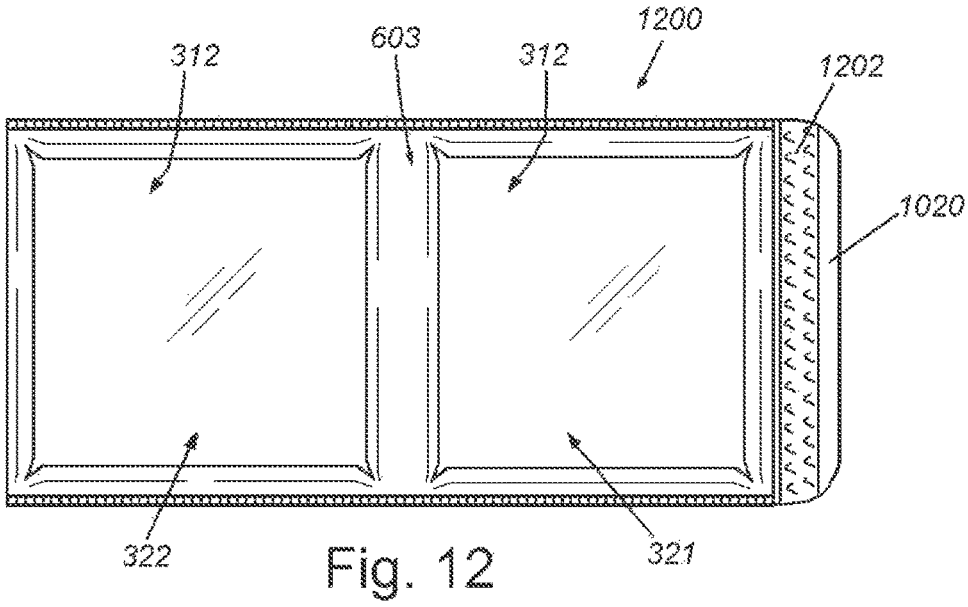
FIG. 12 is a bottom view of a hinging lid, according to the second embodiment.

FIG. 12 is a view of the bottom surface 1200 of the hinged lid 1010. The materials used in the various layers of the lid are as set forth above in the earlier embodiment. The pull flap tab 1020 includes a segment 1202 of a hook and loop enclosure mechanism that functions as above to secure the pull flap tab 1020 when the hinged lid is closed. The illustrative hinged lid is provided with two lid segments 312, rather than three or more. An articulating hinge 603 between the two lid segments 312 provides a hinge between the two lid segments 312, and allows a first lid segment 322 to be in an open position while the second lid segment 322 remains in a closed position. This will provide for only two open positions for the hinged lid 1010. In alternate embodiments, a larger number of lid segments can be used.

Figure 13:
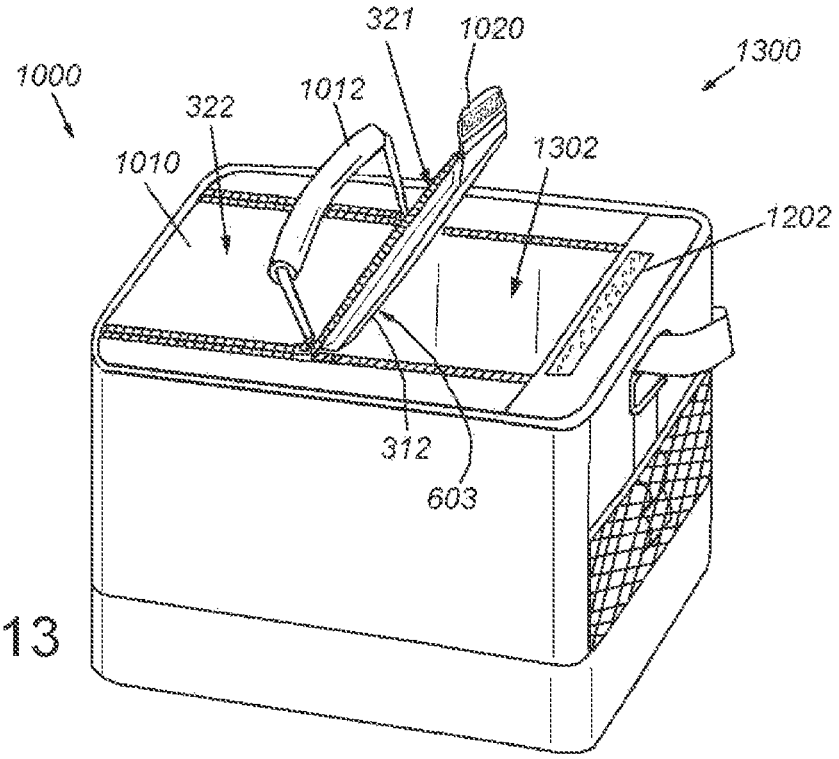
FIG. 13 is a side view of a cooler with a hinging lid in a first open position, according to the second embodiment.

A cooler with the hinging lid 1010 in a first open position 1300 is depicted in FIG. 13. This first open position 1300 is defined as a position wherein one segment 312 is opened and swung away from the opening 1302.

Figure 14:
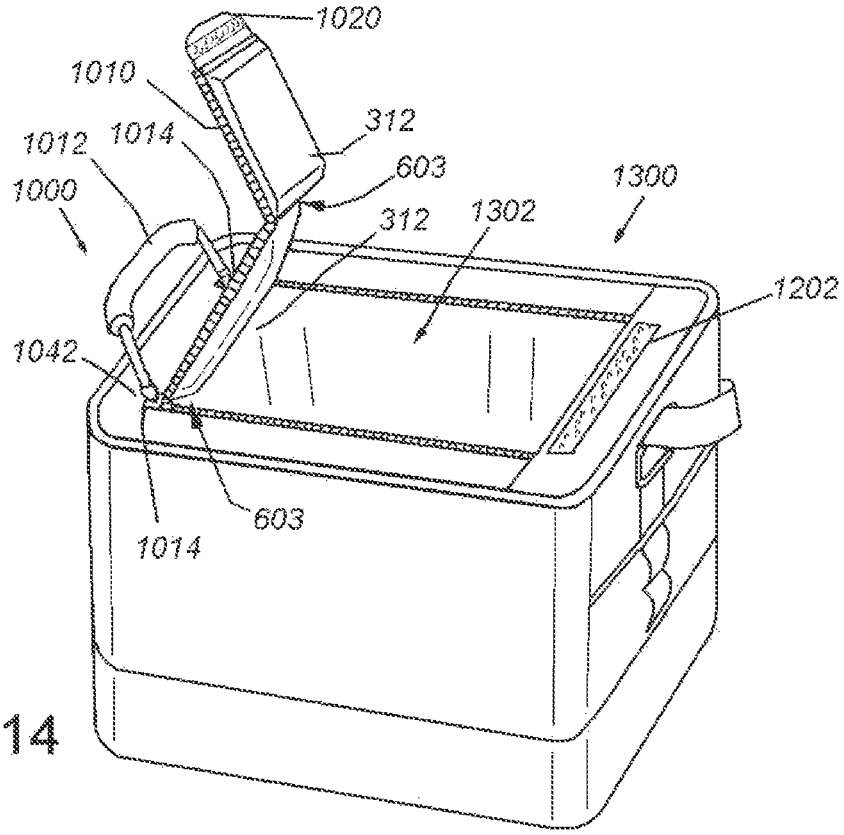
FIG. 14 is a side view of a cooler with a hinging lid in a second open position, according to the second embodiment.

FIG. 14 depicts a second open position 1400 for the smaller cooler. To achieve the second open position 1400, the user initiates the opening as set forth above, but continues to pull the zippers in a rearward direction after the first open position until a second segment 312 has been freed and the zippers 1014 have reached the end of rearward travel.

Figure 15:
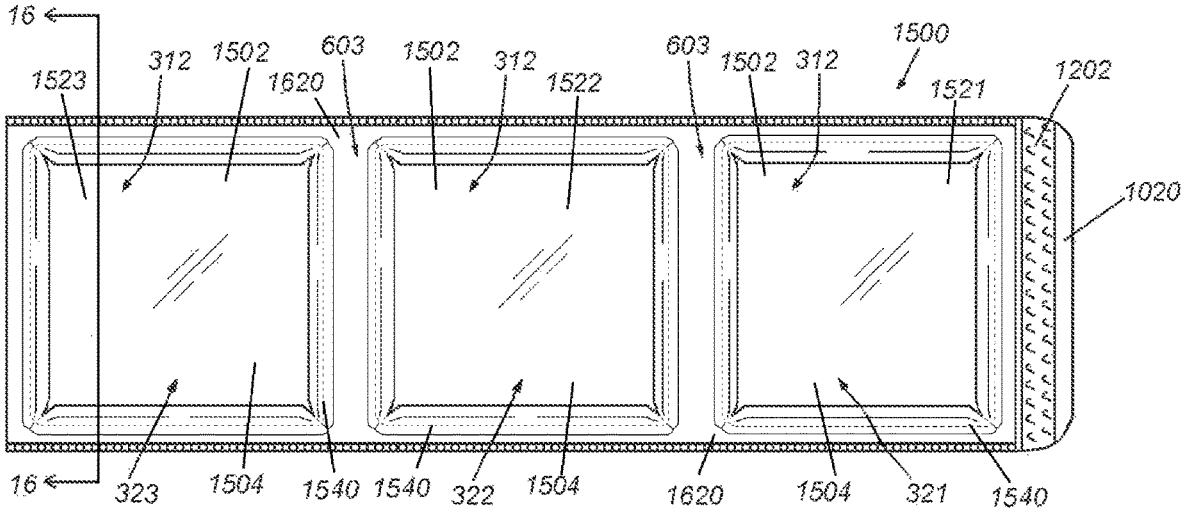
FIG. 15 is a bottom view of a hinging lid showing a bottom inner layer divided into segments, according to an illustrative embodiment.

FIG. 15 is a bottom view of a hinging lid showing a bottom inner layer divided into segments, according to an illustrative embodiment. The interior volume of the cooler is created by the joinder of the surrounding vertical wall, the bottom, the top deck and the hinging lid 1500. Thus, the bottom side of the hinging lid 1500 is also a removable top defining that interior volume. As noted above, the interior layer of the sidewalls can be constructed of a waterproof material that can be reflective, and can otherwise assist in trapping heat/cold and moisture. The bottom side can be covered with a bottom inner layer 1502 that is similar to the interior layer of the sidewalls. In an illustrative embodiment, the hinging lid 1500 is constructed with a rigid (or semi-rigid) support layer that is divided into at least two segments 312. This support layer can be referred to as the insulating member layer. The hinging lid 1500 as shown is provided with three connected lid segments 312, that include a first lid segment 321, a second lid segment 322, and a third lid segment 323. In other embodiments, there can be two, four or more lid segments 312. In the illustrative embodiment, each of the lid segments 312 is uniform in size and shape from one to another. In other embodiments, each of the lid segments can be of various sizes. The insulating support layer can be divided into separate insulating members, so that each lid segment has one or more separate insulating members. The articulating hinges 603 can be located at the spaces between the segments, and the spaces between the insulating members within the segments. A division of the insulating support layer into multiple segments provides for improved flexibility in the hinging lid 1500 and a greater degree of movements, so that the hinging lid can be partially opened while a remainder of the lid remains anchored by the zippers.

Bottom inner layer 1502 can also be divided into segments 1504, with each separate portion of the bottom inner layer 1502 covering one lid segment 312. The bottom inner layer can include a first bottom inner layer segment 1521, a second bottom inner layer segment 1522, and a third bottom inner layer segment 1523. In various embodiments, there can be two, or four or more bottom inner layer segments. The number of bottom inner layer segments 1504 can be the same as the number of lid segments 312. Each lid segment 312 can be covered by a separate bottom inner layer segment 1504. Each bottom inner layer segment 1504 can be stitched, glued, welded, or otherwise attached around the insulating members. Each bottom layer can be stitched, glued, welded, or otherwise attached to the at least one inner septum layer 1620. FIG. 13 depicts bottom inner layer segments 1504 that cover the insulating member segments and are attached to the one or more inner septum layers 1620 by stitching 1540. The articulating hinges 603 can be at the spaces between the bottom inner layer segments 1504, and the bottom inner layer 1502 can be divided into segments at the articulating hinges 603.

Figure 16:
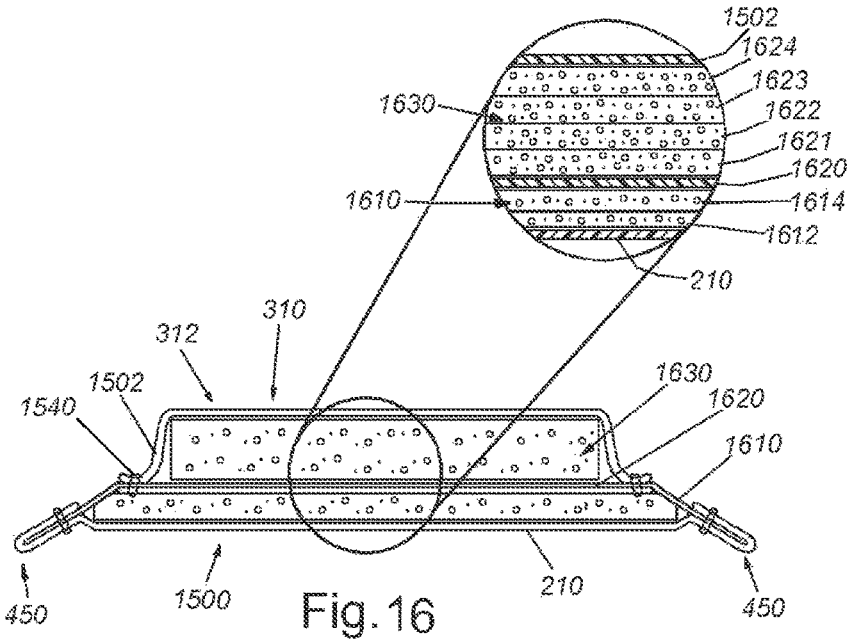
FIG. 16 is a cross section view taken along lines 16-16 of FIG. 15, according to an illustrative embodiment.

FIG. 16 is a cross section view taken along lines 16-16 of FIG. 15, according to an illustrative embodiment. FIG. 16 shows the inner structure of the hinging lid 1500 with respect to the layers. In an illustrative embodiment, the top exterior layer 210 is shown as being "down", and the bottom side 310 is "up". The inner structure of the hinging lid 1500 can be comprised of two layers of insulation, such as an open cell foam 1610, 1630 with an intervening septum 1620. Working from the bottom to the top of the layers as shown in FIG. 15, the top exterior layer 210 is shown on the downside. A layer of insulating material 1610 can be on top of the top exterior layer 210. The layer of insulating material 1610 can be one or more layers of open cell foam. In various embodiments, the layer of insulating material 1610 can be a composite that can include more than one layer of open cell foam. In an embodiment, the layer of insulating material 1610 can be composed of two sub-layers 1612, 1614. The two sublayers 1612, 1614 can be 3 mm open cell foam panels, for an overall thickness of 6 mm, although various thicknesses and numbers of layers are possible in various embodiments. A septum layer 1620 can reside upon the layer of insulating material 1610. Septum 1620 can be formed of a nonwoven material. A segmented insulating member layer 1630 can be open cell foam that can reside on top of the septum layer 1620. In various embodiments, the segmented insulating member layer 1630 can be a composite that can include one or more layers of open cell foam. In an embodiment, the segmented insulating member layer 1630 can be composed of four sub-layers 1621, 1622, 1623, 1624 of 3 mm open cell foam panels, for an overall thickness of 12 mm although various thicknesses and numbers of layers are possible in various embodiments.

The bottom inner layer 1502 can be formed of a nonwoven material and can reside upon the segmented insulating member layer 1630. In various embodiments, the bottom inner layer 1502 can be constructed of a heat sealed PEVA (polyethylene vinyl acetate). The bottom inner layer 1502 can be stitched to the septum layer 1620 and the septum layer 1620 can be stitched to the top exterior layer 210. A portion of the zippers 450 can be stitched at either side of the hinging lid 1500. In the illustrative embodiment, the segmented insulating member layer 1630 is thicker than the layer of insulating material 1610. In other embodiments, the segmented insulating member layer 1630 and the layer of insulating material 1610 can be of the same thickness, or the layer of insulating material can be thicker than the segmented insulating member layer 1630. The segmented insulating member layer 1630 is shown as narrower than the layer of insulating material 1610, so as to create a "stepped" appearance in cross section. In other embodiments, the layers can be uniform in width.

It should be clear that the above-described coolers with a hinged lid provide a system by which the contents of the interior of a cooler can be accessed such that the resultant loss of cooled and moistened air from within the cooler as a result of a heat exchange with ambient air is minimized. The desirable minimization of the size of the opening provided by the various implementations and/or embodiments herein effectively reduces that heat exchange, thereby extending the life of the coolants within the cooler and/or maintaining a lower temperature.

The foregoing has been a detailed description of illustrative embodiments of the invention. Various modifications and additions can be made without departing from the spirit and scope of this invention. Features of each of the various embodiments described above can be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, also as used herein, various directional and orientational terms (and grammatical variations thereof) such as "vertical", "horizontal", "up", "down", "bottom", "top", "side", "front", "rear", "left", "right", "forward", "rearward", and the like, are used only as relative conventions and not as absolute orientations with respect to a fixed coordinate system, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances (e.g. 1-2%) of the system. Also, while the above listed coolers are depicted as being held together with stitched seams, it is expressly contemplated that the use of welds, adhesives and/or rivets can be used instead of stitched seams. More than three lid segments can be provided. Additional handles, straps, carriers and wheels can be added to the cooler. Furthermore, the coolers described above can be sold together as part of a kit. The smaller cooler is sized such that it can be fitted through the opening and stored within the larger cooler without great deformity. Accordingly, this description is meant to be taken only by way of example, and not to otherwise limit the scope of this invention.

What is claimed is:

1. A cooler comprising:

a top deck having an opening and a hinging lid to cover the opening, the hinging lid attached to the cooler at a lid hinge, the hinging lid defining at least one articulating hinge extending through the hinging lid, the hinging lid comprising:

a top outer layer;

a bottom inner layer, the bottom inner layer comprised of a plurality of bottom inner layer segments arranged along a length of the hinged lid;

a plurality of insulating members arranged along a length of the hinged lid with a space between the insulating members, the space between the insulating members dividing the hinging lid into a first segment and a second segment, the insulating members located between the top outer layer and the bottom inner layer segments, wherein the hinging lid defines the articulating hinge located at the space between the insulating members;

a layer of insulating material located between the top outer layer and the plurality of insulating members;

an intervening septum layer between the insulating members and the layer of insulating material, wherein the bottom inner layer is attached to the intervening septum layer at the space between the insulating members, thereby further defining the at least one articulating hinge;

insulated sidewalls; and a bottom.

2. The cooler as set forth in claim 1, wherein the top deck with the hinging lid, sidewalls and bottom define an enclosed insulated inner volume for storage of objects, wherein the enclosed insulated inner volume can be accessed by opening the hinging lid.

3. The cooler as set forth in claim 1, wherein the bottom inner layer segments are attached to the layer of insulating material, thereby further defining the at least one articulating hinge.

4. The cooler as set forth in claim 1, further comprising a first zipper between a first edge of the hinging lid and the opening, and a second zipper between a second edge of the hinging lid and the opening, whereby the hinging lid can be selectively secured to the top deck by zipping the first and second zippers.

5. The cooler as set forth in claim 2, wherein at least a portion of the inner insulated volume is enveloped in a reflective insulating material.

6. The cooler as set forth in claim 1, further comprising a waterproof woven synthetic material on an exterior of the cooler, thereby preventing liquids from leaking out of the bottom of the cooler.

7. The cooler as set forth in claim 1, wherein the hinging lid can be articulated for the first segment that is folded back to create a first partial opening that provides access to the inner insulated volume, the first partial opening being smaller than the opening in the top deck.

8. The cooler as set forth in claim 7, wherein the hinging lid can be articulated for the first segment and the second segment that are folded back to create a second partial opening that provides access to the inner volume.

9. The cooler as set forth in claim 1, wherein the hinging lid comprises three discrete segments comprising the first segment, the second segment and a third segment.

10. The cooler as set forth in claim 9, wherein the hinging lid can be articulated for the first, second and third segments that are folded back to create the opening of the top deck that provides access to the inner insulated volume.

11. The cooler as set forth in claim 1, wherein the hinging lid can be selectively opened, segment by segment, to access the inner volume while minimizing the exchange of air between the inner volume and the air surrounding the cooler.

12. An articulating lid for a cooler comprising:

a top outer layer;

a bottom inner layer, the bottom inner layer comprised of a plurality of bottom inner layer segments arranged along a length of the hinged lid;

a plurality of insulating members arranged in a row along a length of the articulating lid with a space between the insulating members, the insulating members located between the top outer layer and the bottom inner layer segments, wherein the articulating lid defines an articulating hinge located at the space between the insulating members;

a layer of insulating material located between the top outer layer and the plurality of insulating members; and an intervening septum layer between the insulating members and the layer of insulating material, wherein the bottom inner layer segments are attached to the intervening septum layer at the space between the insulating members, thereby further defining the articulating hinge.

13. The articulating lid of claim 12, further comprising a portion of a first zipper located along the length of and at a first edge of the articulating lid, and the articulating lid further comprising a portion of a second zipper located along the length of and at a second edge of the articulating lid.

14. A cooler comprising:

a top deck defining an opening and a hinging lid to cover the opening, the hinging lid attached to the cooler at a lid hinge, the hinging lid defining at least one articulating hinge extending through the hinging lid, the hinging lid comprising:

a top outer layer;

a bottom inner layer, the bottom inner layer comprised of a plurality of bottom inner layer segments arranged along a length of the hinged lid;

a plurality of insulating members arranged along a length of the hinging lid with a space between the insulating members, the space between the insulating members dividing the hinging lid into a plurality of segments, the insulating members located between the top outer layer and the bottom inner layer segments, wherein the hinging lid defines the articulating hinge located at the space between the insulating members;

an intervening septum layer between the insulating members and the top outer layer, wherein the bottom inner layer segments are attached to the intervening septum layer at the space between the insulating members, thereby further defining the at least one articulating hinge;

insulated sidewalls; and a bottom.

* * * * *